US008465336B2

(12) United States Patent
Byrd

(10) Patent No.: US 8,465,336 B2
(45) Date of Patent: Jun. 18, 2013

(54) EXPANDABLE PACKAGING ASSEMBLY

(75) Inventor: Brian C. Byrd, Brooklyn, NY (US)

(73) Assignee: Mattel, Inc., El Segundo, CA (US)

( * ) Notice: Subject to any disclaimer, the term of this patent is extended or adjusted under 35 U.S.C. 154(b) by 212 days.

(21) Appl. No.: 12/769,724

(22) Filed: Apr. 29, 2010

(65) Prior Publication Data

US 2011/0269367 A1 Nov. 3, 2011

(51) Int. Cl.
*A63H 33/00* (2006.01)

(52) U.S. Cl.
USPC ..... 446/69; 446/82; 446/489; 206/461

(58) Field of Classification Search
USPC .. 446/69, 82, 147–152, 71, 73, 489; 206/758, 206/767, 768, 774
See application file for complete search history.

(56) References Cited

U.S. PATENT DOCUMENTS

| | | | | |
|---|---|---|---|---|
| 958,857 | A | 5/1910 | Dennis | |
| 2,410,161 | A | 10/1946 | Helbein | |
| 3,691,671 | A | 9/1972 | Kroll | |
| 3,924,734 | A | 12/1975 | Gardner | |
| 4,025,137 | A | 5/1977 | Wyler | |
| 4,079,873 | A | 3/1978 | De La Mora | |
| 4,185,739 | A | 1/1980 | Wilford | |
| 4,392,605 | A | 7/1983 | Backman | |
| 5,016,772 | A * | 5/1991 | Wilk | 220/8 |
| 5,026,128 | A | 6/1991 | Groetzinger | |
| 5,129,510 | A | 7/1992 | Wright | |
| 5,139,186 | A | 8/1992 | Loew | |
| 5,192,019 | A * | 3/1993 | Meehan | 229/101 |
| 5,458,525 | A | 10/1995 | How | |
| 5,855,291 | A * | 1/1999 | Ingle | 220/6 |
| 5,875,912 | A * | 3/1999 | Hobson | 220/4.03 |
| 7,296,679 | B2 | 11/2007 | Lam | |
| 7,694,445 | B2 * | 4/2010 | Kelly | 40/491 |
| 7,726,482 | B2 * | 6/2010 | Rice | 206/463 |
| 7,845,099 | B2 * | 12/2010 | Ross et al. | 40/124.08 |
| 2005/0048866 | A1 | 3/2005 | Ellman | |
| 2008/0060975 | A1 | 3/2008 | Young | |
| 2010/0203795 | A1 | 8/2010 | Rice | |
| 2010/0311301 | A1 * | 12/2010 | Park | 446/148 |

OTHER PUBLICATIONS

International Search Report dated Aug. 23, 2011 from PCT/US2011/020484.

* cited by examiner

*Primary Examiner* — Gene Kim
*Assistant Examiner* — John E Simms, Jr.
(74) *Attorney, Agent, or Firm* — Edell, Shapiro & Finnan, LLC

(57) ABSTRACT

A packaging assembly for a reconfigurable toy includes a base component and a side component movably connected to the base component. The toy includes a main body and an extendable member movably connected to the main body. The toy is reconfigurable between a first configuration in which the extendable member is retracted relative to the main body and a second configuration in which the extendable member is extended relative to the main body. The main body of the toy is coupled to the base component and the extendable member of the toy is coupled to the side component, so that the toy is reconfigurable between its first configuration and its second configuration while remaining coupled to the packaging assembly.

20 Claims, 14 Drawing Sheets

EXPANDABLE PACKAGING ASSEMBLY

FIELD OF THE INVENTION

The present invention relates to a packaged toy, and in particular a packaged reconfigurable toy that is reconfigurable while remaining coupled to its packaging assembly.

BACKGROUND OF THE INVENTION

Conventional packaging assemblies, such as corrugated boxes, plastic bags and boxes, backer boards, etc, typically enclose or protect the item being packaged for storage, transport and/or point of purchase display. In addition to the basic function of providing protection and convenient shipping and product handling assemblies for products, designers of toy packaging expend great effort on making the packaging for toy products colorful, interesting, eye-catching, informative, and entertaining. There is a need for a unique packaging assembly for packaging a reconfigurable item that permits reconfiguration of the item while the item remains coupled to the packaging assembly.

SUMMARY OF THE INVENTION

The present invention relates to a packaged toy including a toy and a packaging assembly. The toy has a main body and an extendable member movably connected to the main body. The toy is reconfigurable between a first configuration in which the extendable member is retracted relative to the main body and a second configuration in which the extendable member is extended relative to the main body. The packaging assembly includes a base component and at least one side component movably connected to the base component. The main body of the toy is coupled to the base component and the extendable member of the toy is coupled to the side component, so that the toy is reconfigurable between its first configuration and its second configuration while remaining coupled to the packaging assembly.

In one embodiment, the base component of the packaging assembly has a generally L-shaped configuration including a base and a backing extending upwardly therefrom. In some implementations, the base component includes a pair of slots and the side component includes a pair of clips, each of the clips being slidably retained within a corresponding one of the slots. The side component of the packaging assembly is slidably coupled to the base component of the packaging assembly.

In one embodiment, the extendable member of the toy is a first extendable member. The toy includes a second extendable member movably connected to the main body, the second extendable member being movable toward and away from the main body. In one implementation, the side component of the packaging assembly is a first side component, and the packaging assembly includes a second side component movably coupled to the base component. The second extendable member of the toy is coupled to the second side component so that the second extendable member of the toy is movable relative to the main body of the toy while the toy remains coupled to the packaging assembly.

The present invention is also directed to a reconfigurable toy and packaging assembly. The toy has a main body and opposing first and second end members movably coupled to the main body. The first and second end members are movable between a retracted position and an extended position relative to the main body. The packaging assembly includes a central component and opposing first and second side components movably coupled to the central component. The first side component is movable toward and away from the central component in a first direction and an opposite second direction, and the second side component is movable toward and away from the central component in a third direction and an opposite fourth direction. The first end member of the toy is coupled to the first side component and the second end member of the toy being coupled to the second side component. The first and second end members are movable between the retracted and extended positions while the toy remains coupled to the packaging assembly.

In one embodiment, the first direction is opposite the third direction. In another embodiment, the first direction is substantially perpendicular to the third direction.

In one embodiment, the central component includes a first pair of slots disposed in a first portion thereof and a second pair of slots disposed in a second portion thereof. The first side component has a first pair of clips slidably retained within the first pair of slots, and the second side component has a second pair of clips slidably retained within the second pair of slots. In one implementation, each of the clips includes a stem extending through a corresponding one of the slots, and a flange that is slidable against a surface of the central component.

In one embodiment, each of the first and second side components has a generally L-shaped configuration including a base and a backing extending upwardly therefrom. Each base is movably coupled to the central component. In one implementation, the base of the first side component is substantially coplanar with the base of the second side component.

The present invention also relates to a packaged toy. A packaging assembly includes a base portion, a first side portion, and a second side portion. The first side portion is movably coupled to the base portion, and the second side portion is movably coupled to the base portion. The base portion includes a first slot and a second slot formed therein. The first side portion includes a coupler engaged with the first slot of the base portion to couple the first side portion to the base portion. The second side portion includes a coupler engaged with the second slot of the base portion to couple the second side portion to the base portion. A toy includes a first body portion and a second body portion, the second body portion being movably coupled to the first body portion. The second body portion is coupled to and movable with the second side portion of the packaging assembly.

In one embodiment, the toy includes a third body portion that is movably coupled to the first body portion. The third body portion is coupled to and movable with the first side portion of the packaging assembly. In one implementation, the first body portion is coupled to the base portion of the packaging assembly.

In another embodiment, the first side portion is movable toward and away from the base portion in a first direction and an opposite second direction, and the second side portion is movable toward and away from the base portion in a third direction and an opposite fourth direction. In one embodiment, the first direction is substantially opposite to the third direction. In another embodiment, the first direction is substantially perpendicular to the third direction.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer," "vertical," "horizontal," and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
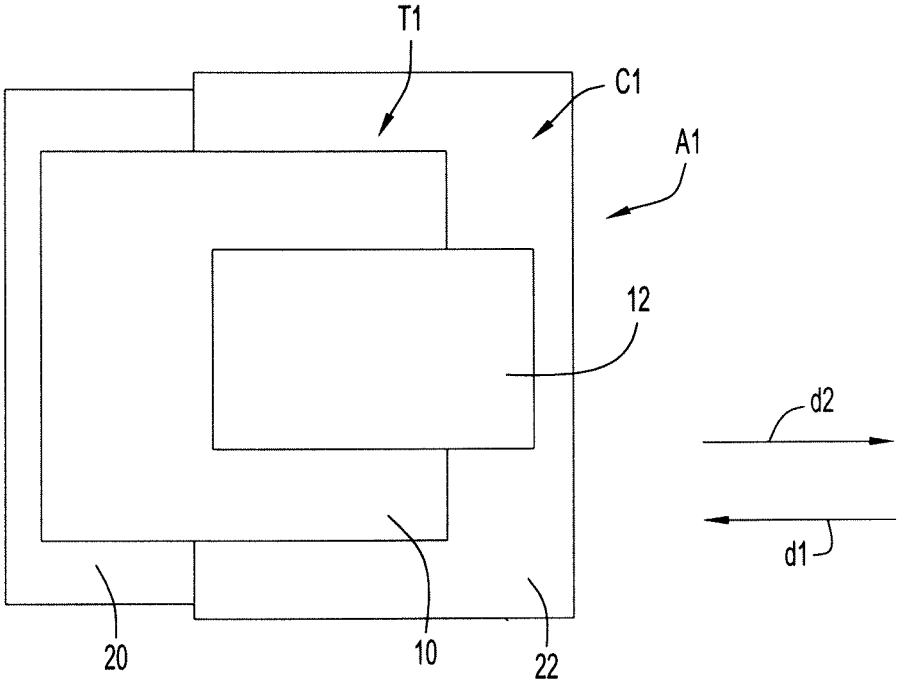
FIG. 1 illustrates a schematic diagram of a reconfigurable toy and packaging assembly according to an embodiment of the present invention and showing the toy and packaging assembly in a retracted configuration.
Figure 2:
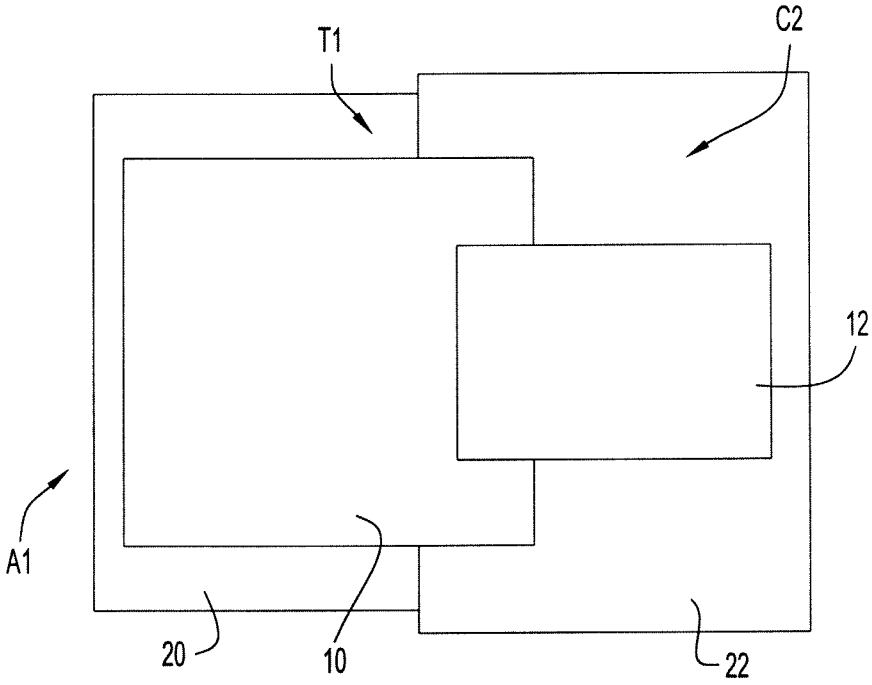
FIG. 2 illustrates a schematic diagram of the reconfigurable toy and packaging assembly of FIG. 1 and showing the toy and packaging assembly in an expanded configuration.

FIGS. 1 and 2 illustrate schematic diagrams of a reconfigurable toy T1 and packaging assembly A1 according to an embodiment of the present invention. The toy T1 has a main body 10 and an extendable member 12 movably connected to the main body 10. The extendable member 12 is movable toward and away from the main body 10 in opposite directions d1, d2. The toy T1 is reconfigurable between a first configuration C1 (shown in FIG. 1) in which the extendable member 12 is retracted relative to the main body 10 and a second configuration C2 (shown in FIG. 2) in which the extendable member 12 is extended relative to the main body 10.

The packaging assembly A1 includes a base component 20 and at least one side component 22 movably connected to the base component 20. The main body 10 of the toy T1 is coupled to the base component 20 and the extendable member 12 of the toy T1 is coupled to the side component 22. Thus, the toy T1 is reconfigurable between its first configuration C1 and its second configuration C2 while remaining coupled to the packaging assembly A1.

Figure 3:
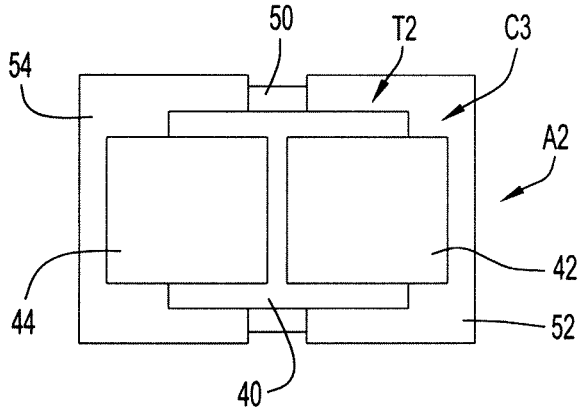
FIG. 3 illustrates a schematic diagram of a reconfigurable toy and packaging assembly according to another embodiment of the present invention and showing the toy and packaging assembly in a retracted configuration.
Figure 4:
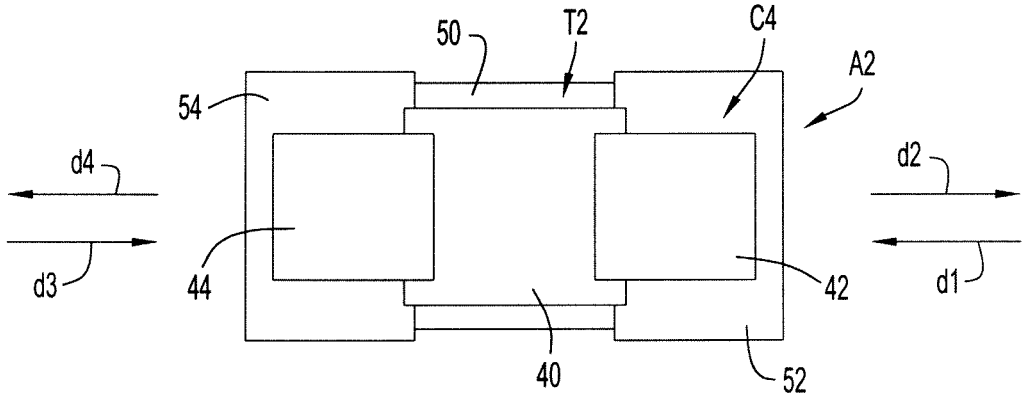
FIG. 4 illustrates a schematic diagram of the reconfigurable toy and packaging assembly of FIG. 3 showing the toy and packaging assembly in an expanded configuration.

FIGS. 3 and 4 illustrate schematic diagrams of a reconfigurable toy T2 and a packaging assembly A2 according to another embodiment. The toy T2 includes a main body 40 and opposing first and second end members 42, 44 movably coupled to the main body 40. The first and second end members 42, 44 are movable between a retracted position C3 (shown in FIG. 3) and an extended position C4 (shown in FIG. 4) relative to the main body 40.

The packaging assembly A2 includes a central component 50 and opposing first and second side components 52, 54 movably coupled to the central component 50. The first side component 52 is movable toward and away from the central component 50 in direction d1 and opposite direction d2. The second side component 54 is movable toward and away from the central component 50 in a direction d3 and an opposite direction d4. In one embodiment, direction d1 is opposite direction d3, and direction d2 is opposite direction d4.

The first end member 42 of the toy T2 is coupled to the first side component 52 of the packaging assembly A2, and the second end member 44 is coupled to the second side component 54. The first and second end members 42, 44 of the toy T2 are movable between the retracted position C3 and the extended position C4 while the toy T2 remains coupled to the packaging assembly A2.

Figure 5:
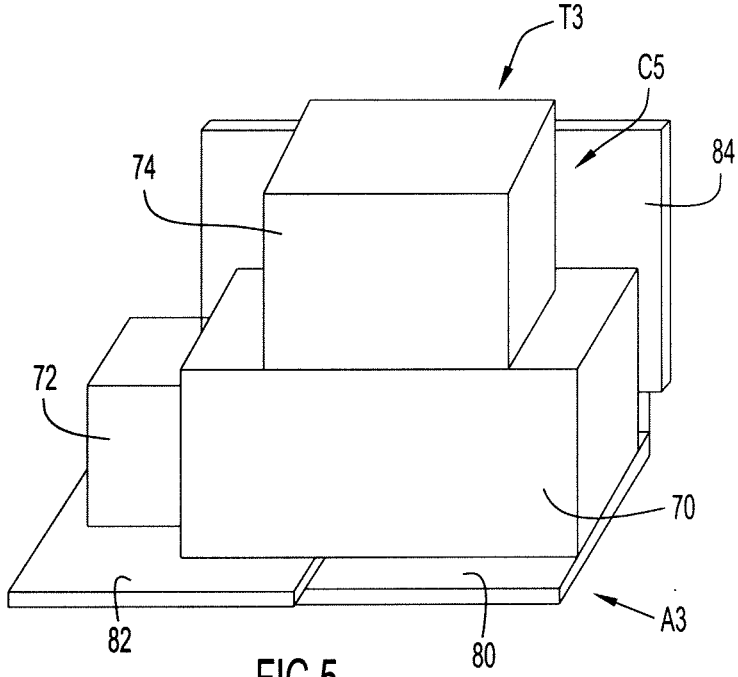
FIG. 5 illustrates a schematic diagram of a reconfigurable toy and packaging assembly according to another embodiment of the present invention and showing the toy and packaging assembly in a retracted configuration.
Figure 6:
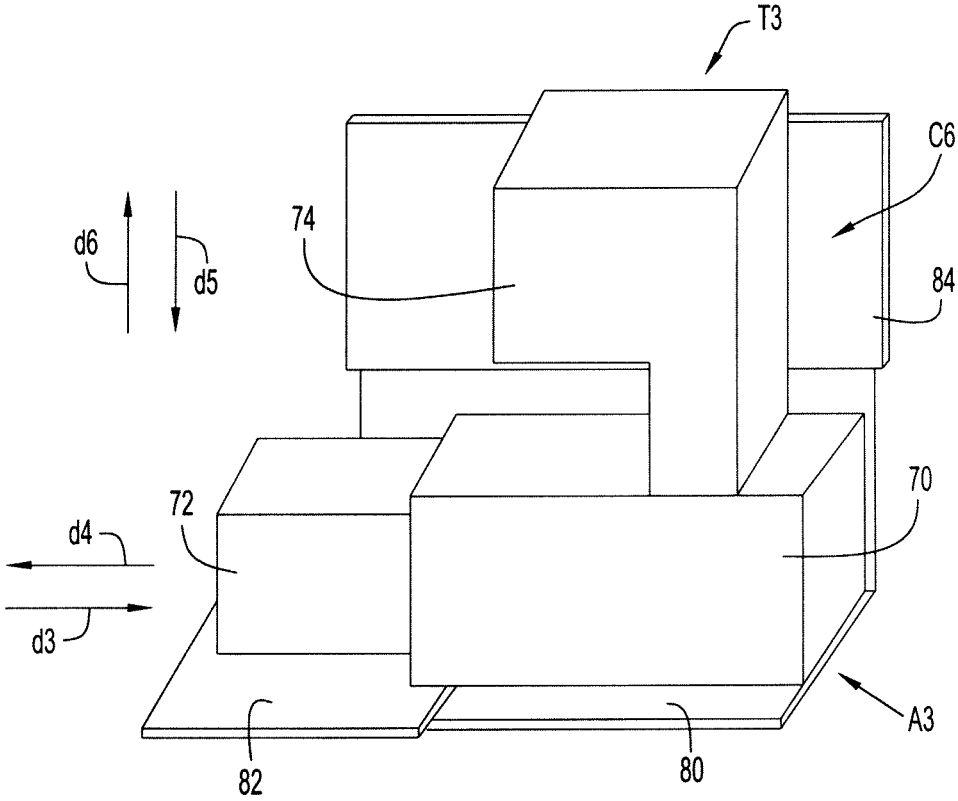
FIG. 6 illustrates a schematic diagram of the reconfigurable toy and packaging assembly of FIG. 5 and showing the toy and packaging assembly in an expanded configuration.

FIGS. 5 and 6 illustrate schematic diagrams of a reconfigurable toy T3 and a packaging assembly A3 according to another embodiment. The toy T3 includes a main body 70 and first and second side members 72, 74 movably coupled to the main body 70. The first and second side members 72, 74 are movable between a retracted position C5 (shown in FIG. 5) and an extended position C6 (shown in FIG. 6) relative to the main body 70.

The packaging assembly A3 includes a central component 80 and first and second side components 82, 84 movably coupled to the central component 80. The first side component 82 is movable toward and away from the central component 80 in direction d3 and an opposite direction d4. The second side component 84 is movable toward and away from the central component 80 in a direction d5 and an opposite direction d6. In one embodiment, directions d3, d4 are substantially perpendicular to directions d5, d6.

The first side member 72 of the toy T3 is coupled to the first side component 82 of the packaging assembly A3, and the second side member 74 is coupled to the second side component 84. The first and second side members 72, 74 of the toy T3 are movable between the retracted position C5 and the extended position C6 while the toy T3 remains coupled to the packaging assembly A3.

Figure 7:
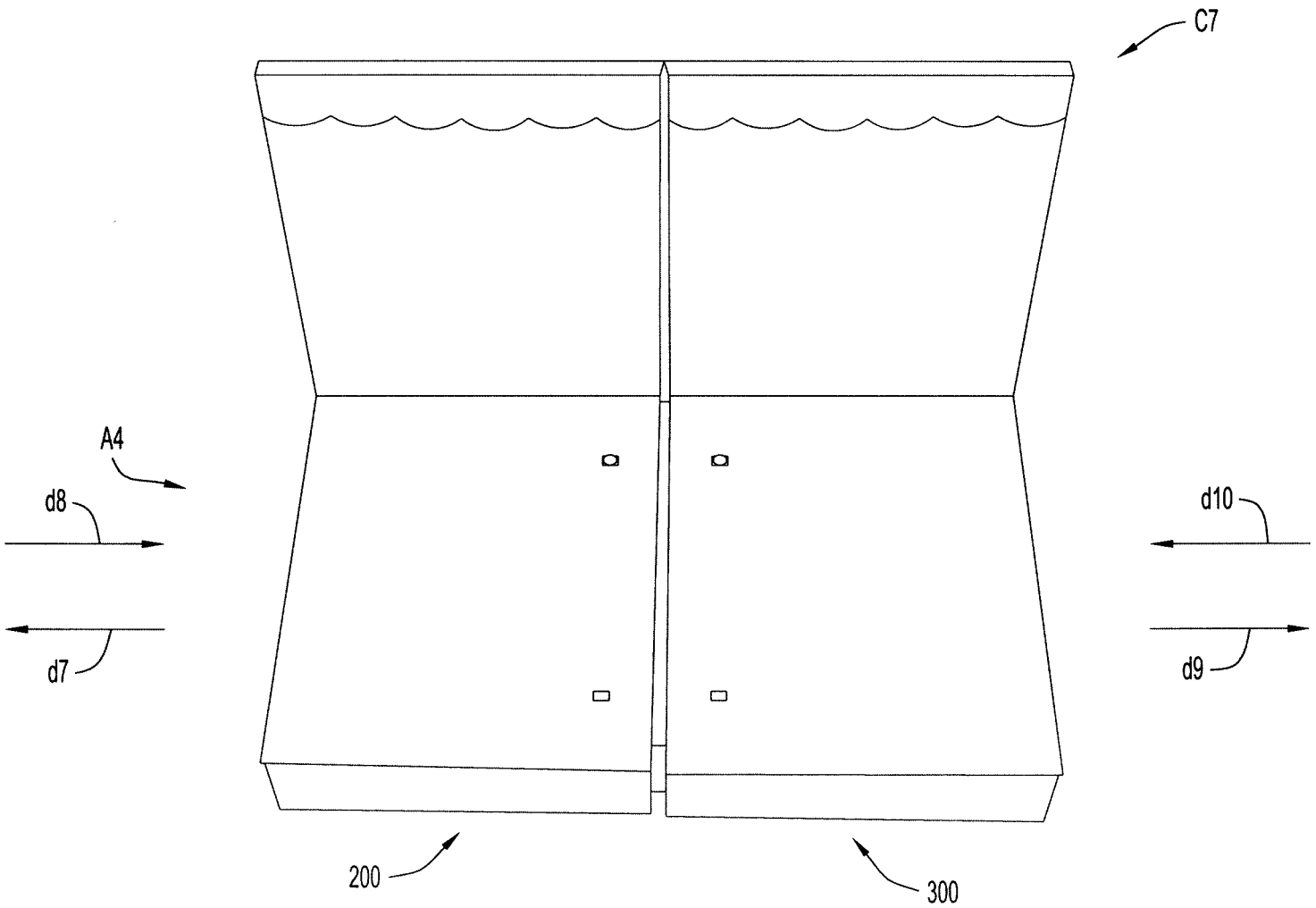
FIG. 7 illustrates a front perspective view of a packaging assembly according to another embodiment of the present invention and showing the packaging assembly in a retracted configuration.
Figure 8:
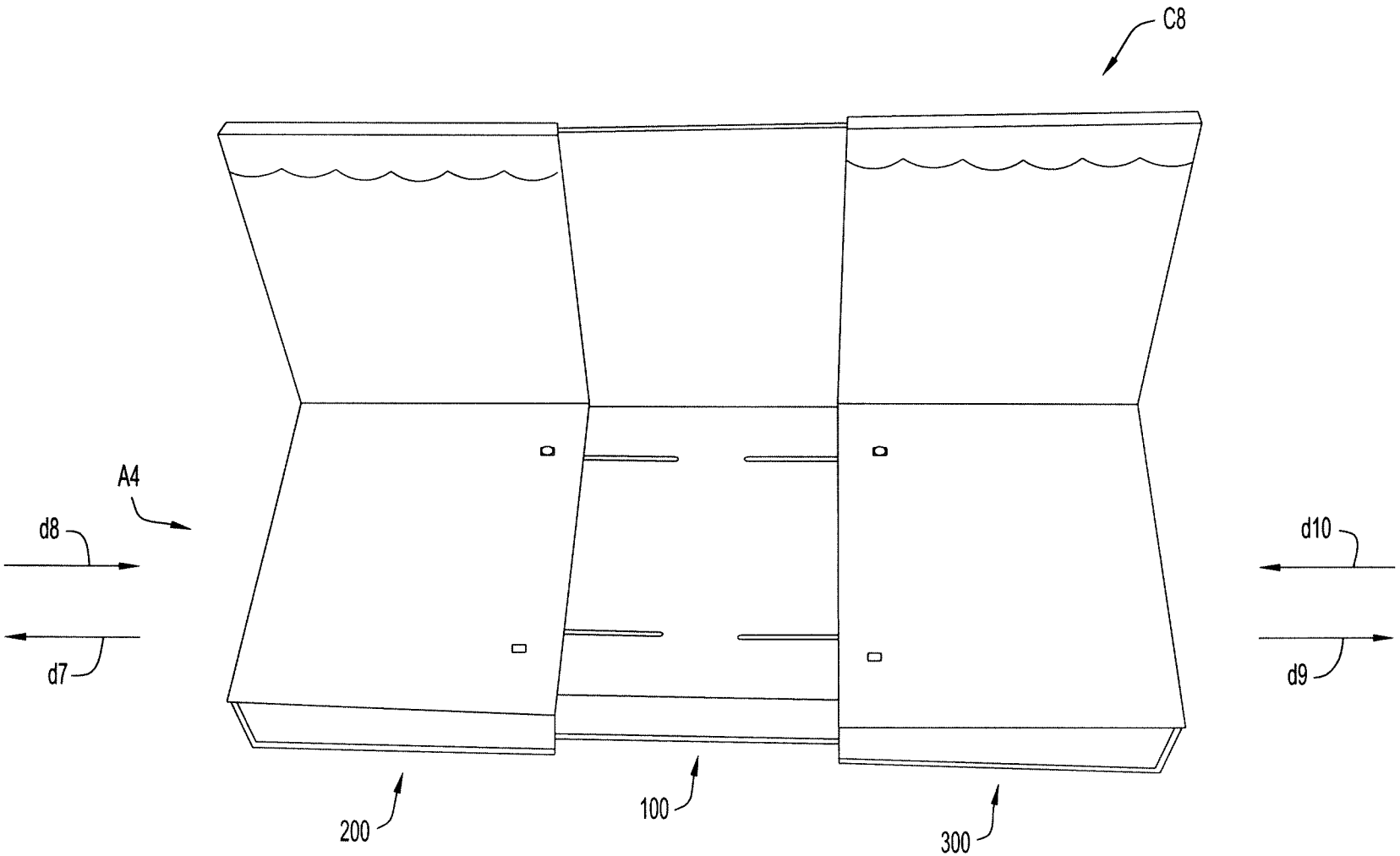
FIG. 8 illustrates another front perspective view of the packaging assembly of FIG. 7 and showing the packaging assembly in an expanded configuration.

A packaging assembly A4 according to another embodiment is illustrated in FIGS. 7 and 8. The packaging assembly A4 includes a base portion 100, a side portion 200, and another side portion 300. The side portion 200 is coupled to the base portion 100 and movable away from the base portion 100 from a retracted configuration C7 (shown in FIG. 7) to an expanded configuration C8 (shown in FIG. 8) in a direction d7, and movable toward the base portion 100 from the expanded configuration C8 to the retracted configuration C7 in a direction d8 opposite direction d7. Similarly, the other side portion 300 is coupled to the base portion 100 and movable away from the base portion 100 from the retracted configuration C7 to the expanded configuration C8 in a direction d9, and movable toward the base portion 100 from the expanded configuration C8 to the retracted configuration C7 in a direction d10 opposite direction d9. In one embodiment, direction d7 is opposite direction d9, and direction d8 is opposite direction d10.

Figure 9:
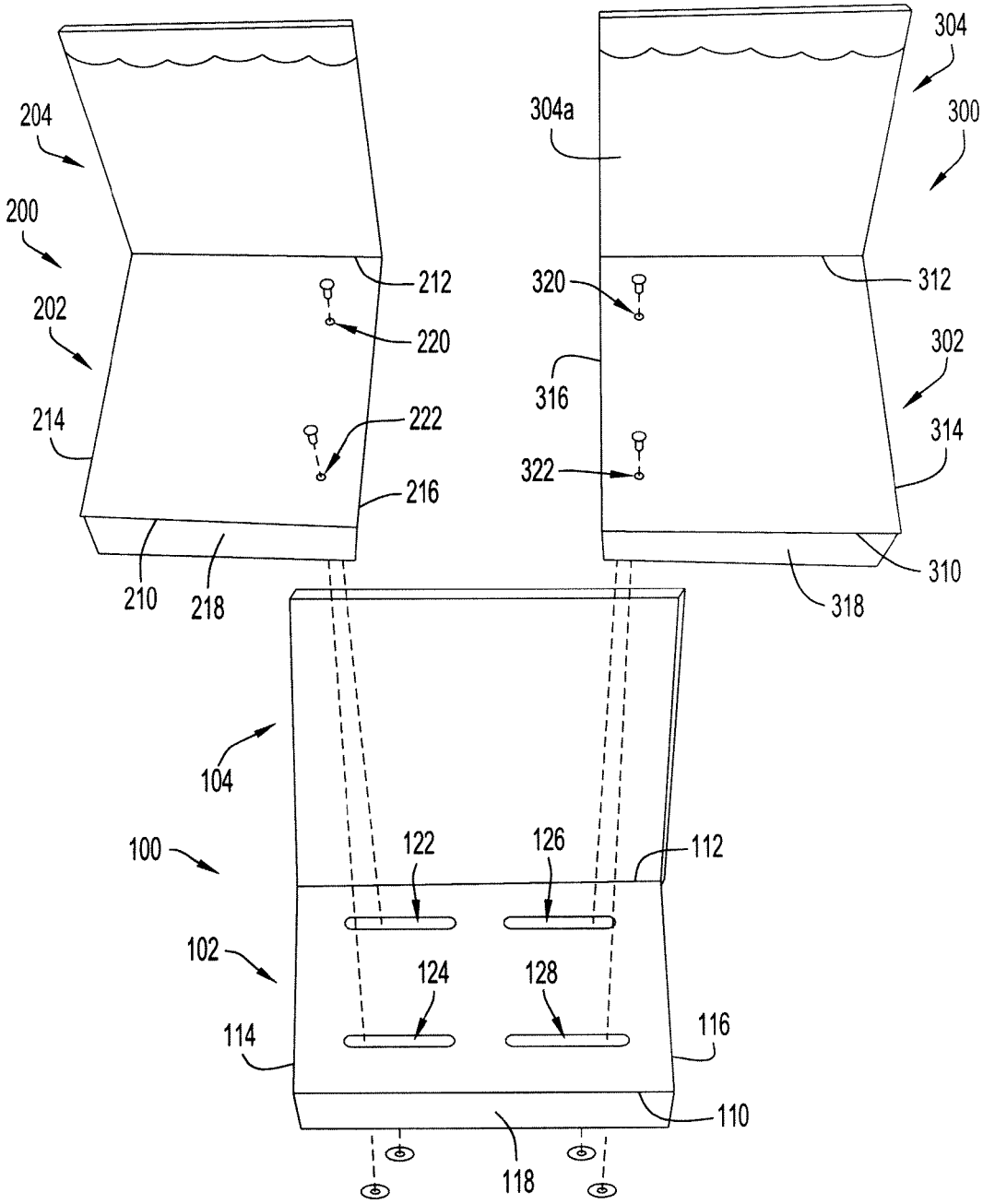
FIG. 9 illustrates an exploded perspective assembly view of the packaging assembly of FIG. 7.
Figure 10:
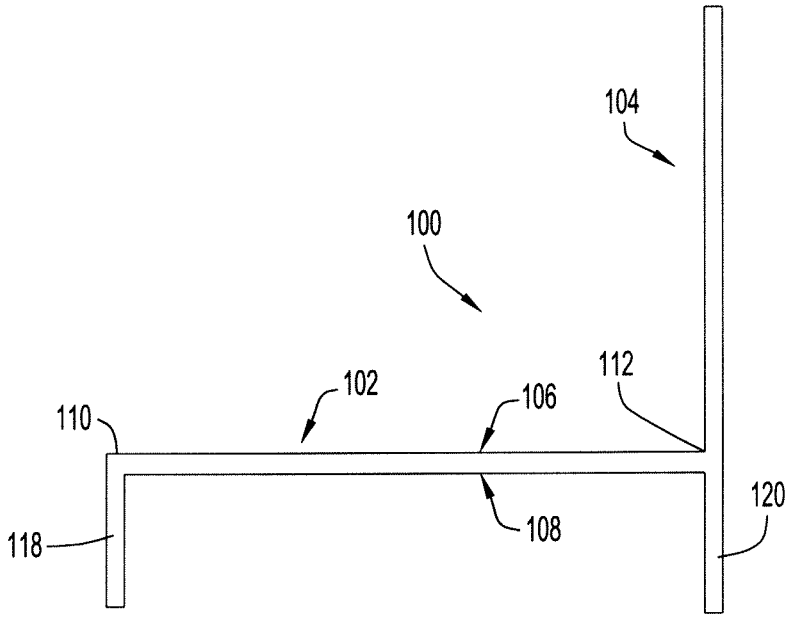
FIG. 10 illustrates a side elevational view of a base portion of the packaging assembly of FIG. 7.

Referring to FIGS. 9 and 10, the base portion 100 has a generally L-shaped configuration including a base 102 and a backing 104 extending upwardly therefrom. The base 102 includes an outer surface 106 and opposing inner surface 108, a front edge 110 and opposing back edge 112, and opposing side edges 114, 116. The backing 104 extends upwardly from or proximate to the back edge 112. In some embodiments, a front wall 118 extends downwardly from or proximate to the front edge 110, and a back wall 120 extends downwardly from or proximate to the back edge 112. The back wall 120 may be integral with, defined by and/or substantially coplanar with a portion of the backing 104, as shown in FIG. 10.

The base 102 defines a pair of slots 122, 124 and another pair of slots 126, 128. In one embodiment, slots 122, 124, 126, 128 extend substantially parallel to the front edge 110 (and/or the back edge 112) and substantially perpendicular to the side edge 114 (and/or the side edge 116). In addition, slot 122 may be substantially collinear with slot 126, and slot 124 may be substantially collinear with slot 128.

Figure 11:
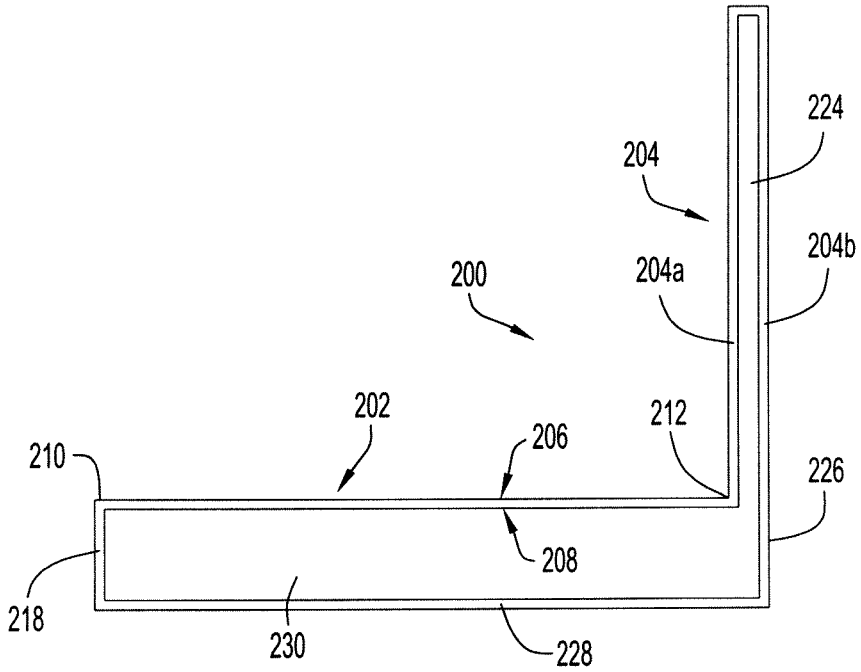
FIG. 11 illustrates a side elevational view of a side portion of the packaging assembly of FIG. 7.

Referring to FIGS. 9 and 11, the side portion 200 also has a generally L-shaped configuration including a base 202 and a backing 204 extending upwardly therefrom. The base 202 includes an outer surface 206 and an opposing inner surface 208, a front edge 210 and opposing back edge 212, and opposing side edges 214, 216. The backing 204 extends upwardly from or proximate to the back edge 212. In some embodiments, a front wall 218 extends downwardly from or proximate to the front edge 210. The base 202 defines a pair of openings 220, 222.

In one embodiment, the backing 204 includes a section 204*a* extending upwardly from and connected to the back edge 212, and another section 204*b* spaced from and parallel to section 204*a*, as shown in FIG. 11. Sections 204*a*, 204*b* define a cavity 224 therebetween. A back wall 226 is integral with, defined by and/or substantially coplanar with a portion of section 204*b*. A bottom section 228 extends between and interconnects the front wall 218 and the back wall 226. Another space or cavity 230 is defined between the inner surface 208 of the base 202 and the bottom section 228, and is in communication with cavity 224 of the backing 204.

Figure 12:
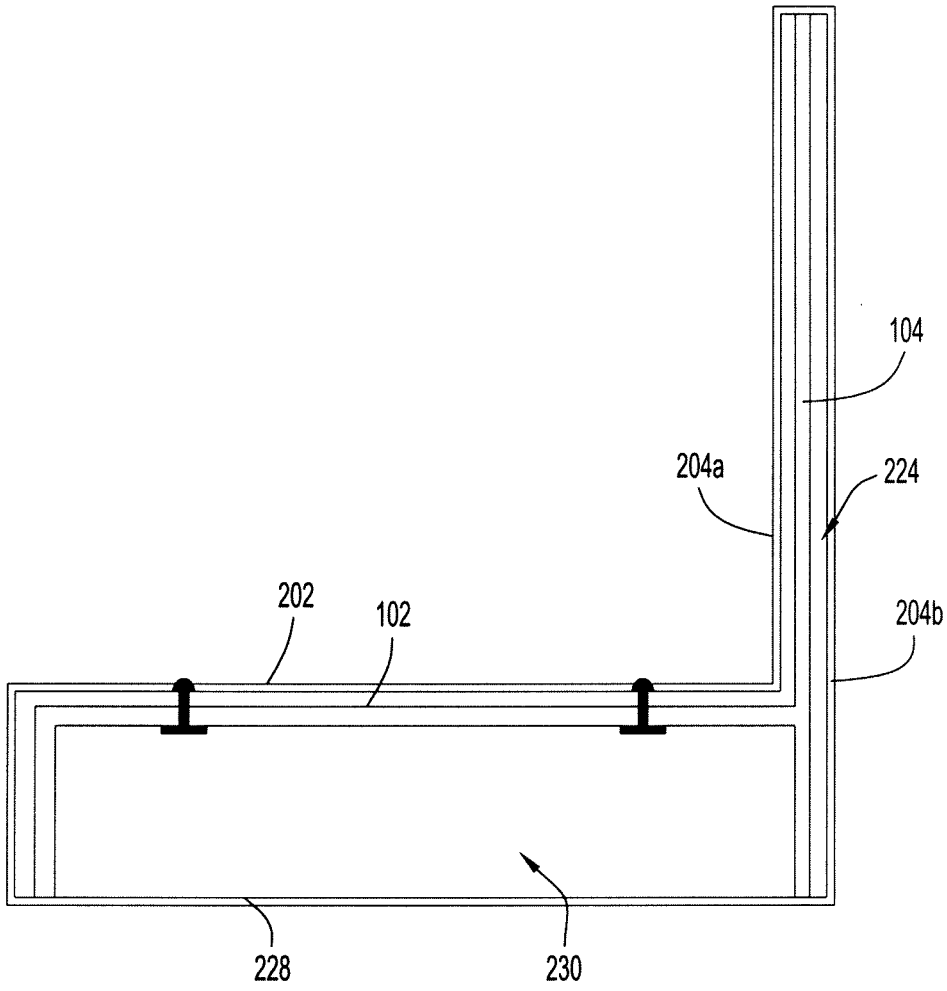
FIG. 12 illustrates a side sectional view of the packaging assembly of FIG. 7.

Referring to FIG. 12, cavity 224 is configured to receive the backing 104 and cavity 230 is configured to receive the base 102. Thus, the side portion 200 encases a portion the base portion 100, which is slidably received within cavities 224, 230.

Figure 13:
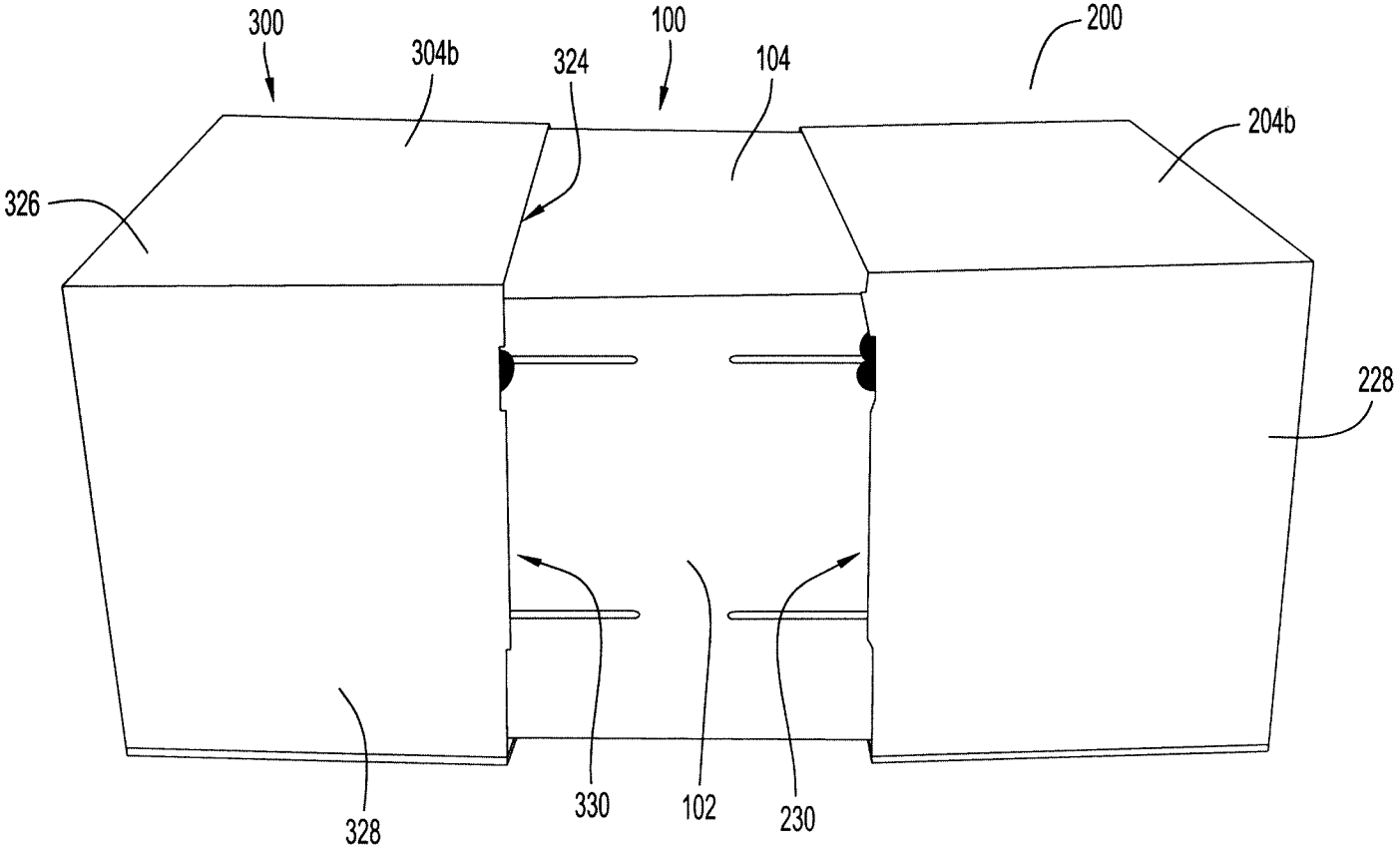
FIG. 13 illustrates a bottom perspective view of the packaging assembly of FIG. 7.

Referring to FIGS. 9 and 13, side portion 300 may likewise have a generally L-shaped configuration including a base 302 and a backing 304 extending upwardly therefrom. The base 302 includes an outer surface and an opposing inner surface (similar to opposing surfaces 206, 208 shown in FIG. 11), a front edge 310 and opposing back edge 312, and opposing side edges 314, 316. The backing 304 extends upwardly from or proximate to the back edge 312. In some embodiments, a front wall 318 extends downwardly from or proximate to the front edge 310. The base 302 defines a pair of openings 320, 322.

Further, side portion 300 may have a shell-like configuration for encasing a portion of the base portion 100 (similar to the configuration of side portion 200 and as shown in FIG. 11). The backing 304 includes a section 304*a* extending upwardly from and connected to the back edge 312, and another section 304*b* spaced from and parallel to section 304*a*. Sections 304*a*, 304*b* define a cavity 324 therebetween. A back wall 326 is integral with or defined by a portion of section 304*b*. A bottom section 328 extends between and interconnects the front wall 318 of the base 302 and the back wall 326. Another space or cavity 330 is defined between the inner surface of the base 302 and the bottom section 328, and is in communication with the cavity 324 of the backing 304. Cavity 324 is configured to receive backing 104 of the base portion 100, and cavity 330 is configured to receive base 102, as shown in FIG. 13.

Each of the side portions 200, 300 are slidably coupled to the base portion 100 and movable away from each other in opposite directions, from the retracted configuration C7 (shown in FIG. 7) to an expanded configuration C8 (shown in FIG. 8) in directions d7, d9, respectively. Each of the side portions 200, 300 are then slidably movable toward each other from the expanded configuration C8 back to the retracted configuration C7 in directions d8, d10, respectively. In one embodiment, the base 202 of side portion 200 is movable along a plane substantially coplanar with the plane along which the base 302 of side portion 300 is movable.

Referring again to FIG. 9, the side portion 200 is coupled to the base portion 100 so that the inner surface 208 of the base 202 is aligned with and/or abuts the outer surface 106 of the base 102. The backing 104 is disposed within cavity 224 and is aligned with and/or abuts section 204*a* of the backing 204. When the side portion 200 is coupled to and aligned with the base portion 100, opening 220 is aligned with slot 122 and opening 222 is aligned with slot 124. The side portion 200 is slidably secured to the base portion 100 via one or more clips or couplers 400, described in further detail below.

Similarly, the side portion 300 is coupled to the base portion 100 so that the inner surface of the base 302 is aligned with and/or abuts the outer surface 106 of the base 102. The backing 104 is disposed within cavity 324 and is aligned with and/or abuts section 304*a* of the backing 304. When the side portion 300 is coupled to and aligned with the base portion 100, opening 320 is aligned with slot 126 and opening 322 is aligned with slot 128. The side portion 300 is slidably secured to the base portion 100 via one or more clips or couplers 400.

Figure 14:
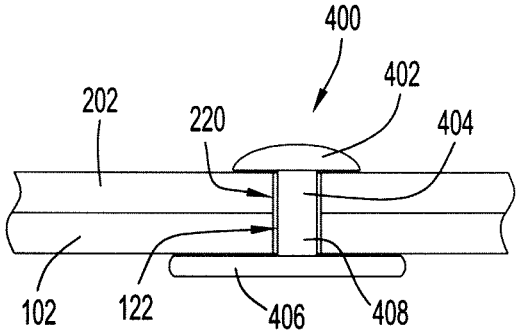
FIG. 14 illustrates a sectional view of a portion of the packaging assembly of FIG. 7 showing a side portion coupled to the base portion via a coupler.
Figure 15:
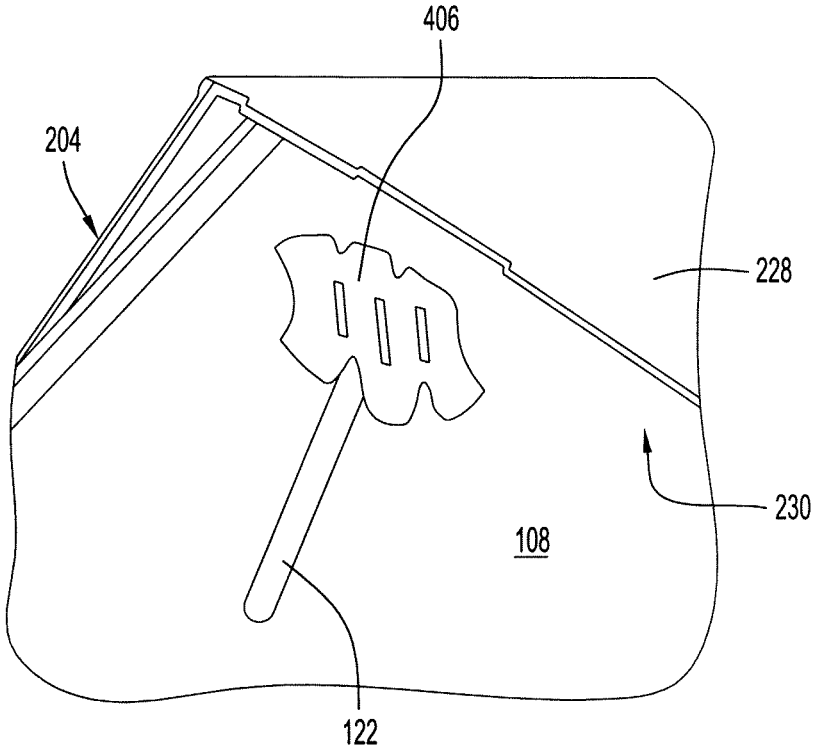
FIG. 15 illustrates a fragmentary perspective view of a portion of the packaging assembly of FIG. 7 showing an exploded view of a coupler.

Referring to FIG. 14, each coupler 400 includes a head 402, a stem 404 received in and extending through a corresponding one of the openings 220, 222, 320, 322 (illustrating opening 220 in FIG. 14) and the correspondingly aligned one of the slots 122, 124, 126, 128 (illustrating slot 122), and a flange 406 coupled to or integral with a distal end 408 of the stem 404. The flange 406 is abuts and is slidable against the inner surface 108 of the base 102, as shown in FIG. 15.

The head 402 of each coupler 400 has a diameter greater than the diameter of the corresponding opening 220, 222, 320, 322. As such, the coupler 400 is retained against the outer surfaces (e.g. outer surface 206) of the bases 202, 302 of the side portions 200, 300. Further, each coupler 400 is slidably retained within a corresponding one of the slots 122, 124, 126, 128 given the diameter of its flange 406 is greater than the width of the corresponding one of the slots 122, 124, 126, 128. However, the length of each of the slots 122, 124, 126, 128 is substantially greater than the diameter of the stem 404 of each coupler 400. Thus, the couplers 400 are slidably movable along the corresponding slots 122, 124, 126, 128, so that the side portions 200, 300 are slidably movable relative to the base portion 100.

Given side portion 200 and side portion 300 are independently coupled to the base portion 100 via couplers 400, side portion 200 is movable toward and away from the base portion 100 (and toward and away from side portion 300) in directions d7, d8 independent of any movement by side portion 300. Accordingly, side portion 300 is movable toward and away from the base portion 100 (and toward and away from side portion 200) in directions d9, d10 independent of any movement by side portion 200.

Figure 16:
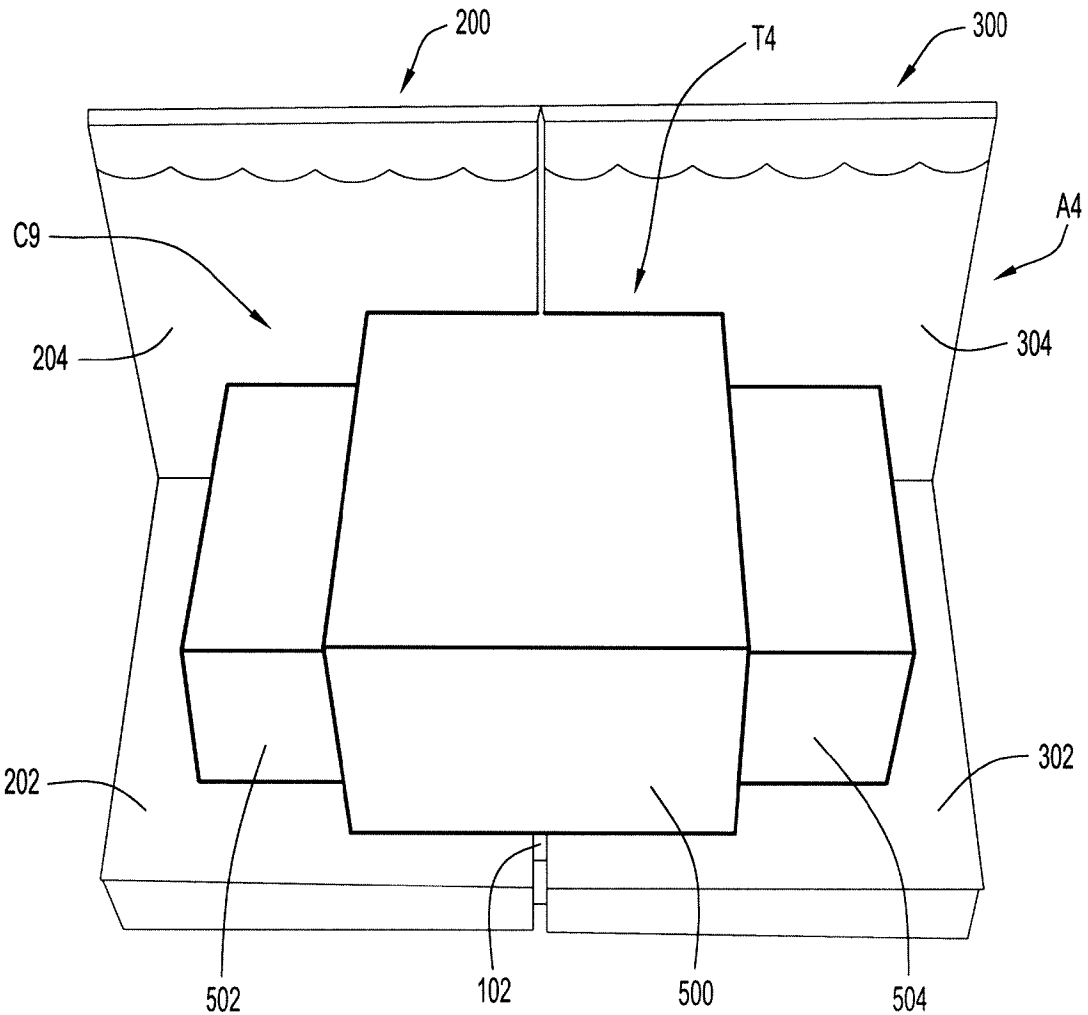
FIG. 16 illustrates a front perspective view of the packaging assembly of FIG. 7 and a reconfigurable toy and showing the packaging assembly and toy in a retracted configuration.
Figure 17:
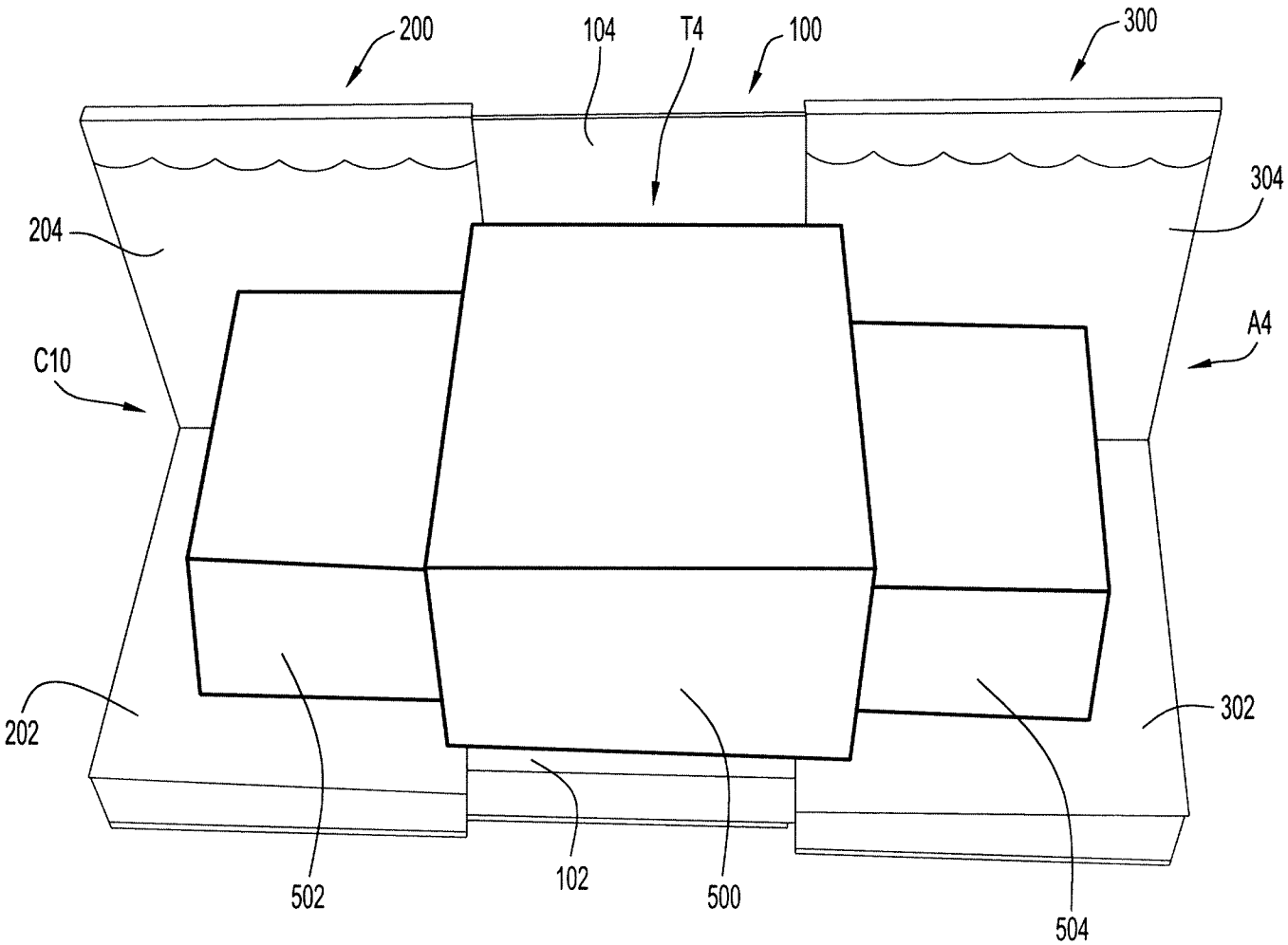
FIG. 17 illustrates another front perspective view of the packaging assembly and toy of FIG. 16 and showing the packaging assembly and toy in an expanded configuration.

A reconfigurable toy T4 coupled to packaging assembly A4 is illustrated in FIGS. 16 and 17. Toy T4 includes a main body 500, an extendable member 502 movably coupled to the main body 500, and another extendable member 504 movably coupled to the main body 500. The extendable members 502, 504 are movable between a retracted position C9 (shown in FIG. 16) and an extended position C10 (shown in FIG. 17) toward and away from the main body 500.

Extension member 502 of the toy T4 is coupled to the base 202 and/or the backing 204 of side portion 200 of packaging assembly A4. Extension member 504 is coupled to the base 302 and/or the backing 304 of side portion 300. The extendable members 502, 504 of the toy T4 are movable between the retracted position C9 and the extended position C10 while the toy T4 remains coupled to the packaging assembly A4, given side portions 200, 300 are slidably movable relative to the base portion 100, as described above.

In one embodiment, the main body 500 is coupled to the base 102 and/or the backing 104 of the base portion 100 of the packaging assembly A4. In this way, the main body 500 remains in a relatively fixed position relative to the base portion 100 even when extension member 502 and/or extension member 504 are slidably moved toward and away from the main body 500.

Figure 18:
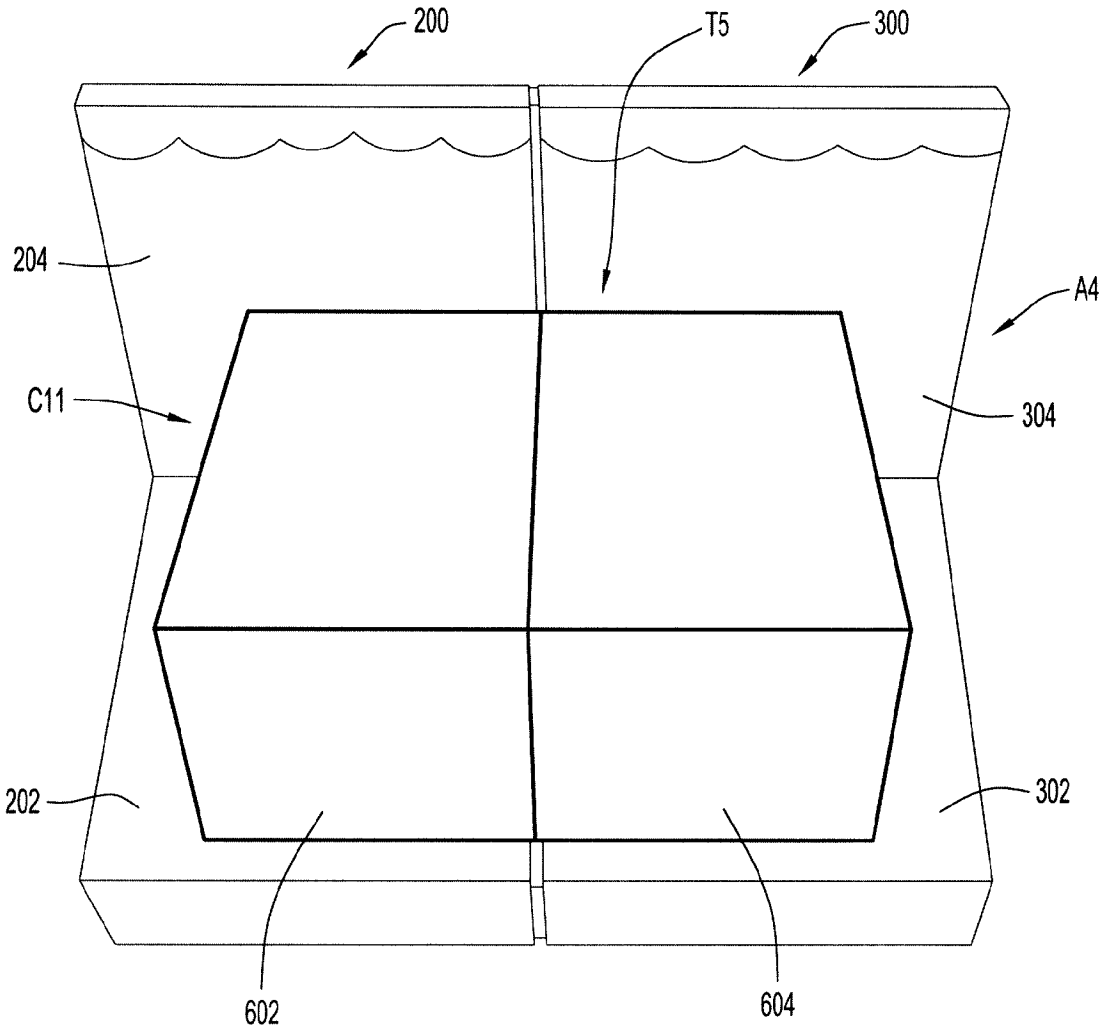
FIG. 18 illustrates a front perspective view of the packaging assembly of FIG. 7 and a reconfigurable toy according to another embodiment, showing the packaging assembly and the toy in a retracted configuration.
Figure 19:
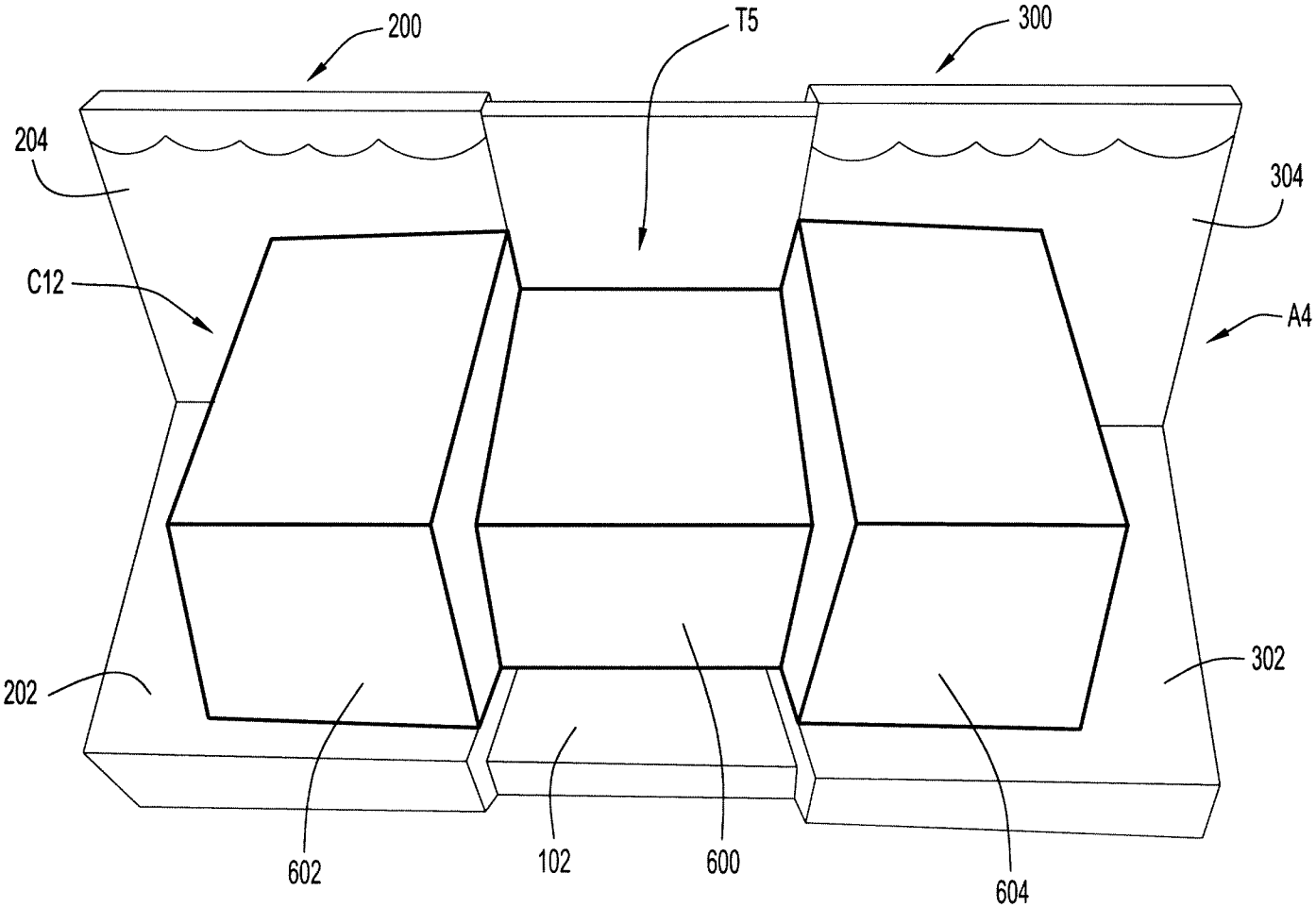
FIG. 19 illustrates another front perspective view of the packaging assembly and toy of FIG. 18 and showing the packaging assembly and toy in an expanded configuration.

A reconfigurable toy T5 according to another embodiment and coupled to packaging assembly A4 is illustrated in FIGS. 18 and 19. Toy T5 includes a central portion 600, an extendable member 602 movably coupled to the central portion 600, and another extendable member 604 movably coupled to the central portion 600. The extendable members 602, 604 are movable between a retracted position C11 (shown in FIG. 18) and an extended position C12 (shown in FIG. 19) toward and away from the central portion 600, and toward and away from each other. In one embodiment, the central portion 600 is smaller than the extendable members 602, 604, and fits within cavities defined by the extendable members 602, 604 when in the retracted position C11.

In one embodiment, extension member 602 of the toy T5 is coupled to the base 202 and/or the backing 204 of side portion 200 of packaging assembly A4. Extension member 604 is coupled to the base 302 and/or the backing 304 of side portion 300. The extendable members 602, 604 of the toy T5 are movable between the retracted position C11 and the extended position C12 while the toy T5 remains coupled to the packaging assembly A4, given side portions 200, 300 are slidably movable relative to the base portion 100, as described above.

In one embodiment, the central portion 600 is coupled to the base 102 and/or the backing 104 of the base portion 100 of the packaging assembly A4. In this way, the central portion 600 remains in a relatively fixed position relative to the base portion 100 even when extension member 602 and/or extension member 604 are slidably moved toward and away from the central portion 600.

Thus, the extendable members 602, 604 are expandable to reveal the central portion 600. In some embodiments, the central portion 600 is a portion of an expandable toy. In other embodiments, the central portion 600 is additional packaging material, and extendable members 602, 604 are separate, non-reconfigurable toys. In either case, the expansion of the packaging assembly A4 and/or expansion of the toy T5 may reveal hidden graphics and/or messages, which are otherwise hidden from view when the packaging assembly A4 and/or the toy(s) are in their retracted positions.

Although the packaging assemblies disclosed herein are sometimes described as including "end portions" or "side portions," it should be understood that such terms do not limit the disclosed embodiments to any particular configuration or orientation. For example, the disclosed packaging assemblies and/or reconfigurable toys may be oriented so that they extend outwardly from a front edge and/or a rear edge of the packaging. Thus, the depth of the packaging and/or of the toy (compared to the width and relative to a consumer positioned in front of or behind the packaging) may be increased or decreased as the packaging assembly and reconfigurable toy is expanded or retracted.

The packaging assemblies A1-A4 disclosed herein permit reconfiguration of a toy (e.g. toys T1-T5) while the toy remains coupled to its packaging assembly. Such a feature allows such a reconfigurable toy to be displayed and supported, such as at point of purchase, while also allowing and encouraging a potential purchaser to try the product without removing it from its packaging. Thus, the disclosed packaging assemblies provide a "try-me" feature for uniquely reconfigurable toys.

The disclosed packaging assemblies A1-A4 may be formed from corrugated material, which is appropriate for many applications. Alternatively, the packaging assemblies A1-A4 may be formed from another material, such as plastic, wood, wood composite, metal, etc. Portions or members of a reconfigurable toy may be secured to a corresponding portion or member of the packaging assembly via wire, cord, bands, clips, or some other appropriate fastener mechanism.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A packaged toy, comprising:

a toy having a main body and a reciprocating member movably connected to the main body, the toy being reconfigurable between a first configuration in which the reciprocating member is retracted relative to the main body and a second configuration in which the extendable member is reciprocating relative to the main body; and a packaging assembly including a base component and at least one side component movably connected to the base component, the main body of the toy being coupled to the base component and the reciprocating member of the toy being coupled to the side component so that the toy is reconfigurable between its first configuration and its second configuration while remaining coupled to the packaging assembly.

2. The packaged toy of claim 1, wherein the side component of the packaging assembly is slidably coupled to the base component of the packaging assembly.

3. The packaged toy of claim 1, wherein the base component has a generally L-shaped configuration including a base and a backing extending upwardly therefrom.

4. The packaged toy of claim 1, wherein the base component includes a pair of slots and the side component includes a pair of clips, each of the clips being slidably retained within a corresponding one of the slots.

5. The packaged toy of claim 1, wherein the reciprocating member of the toy is a first reciprocating member and the toy includes a second reciprocating member movably connected to the main body, the second reciprocating member being movable toward and away from the main body.

6. The packaged toy of claim 5, wherein the side component of the packaging assembly is a first side component and the packaging assembly includes a second side component movably coupled to the base component, the second reciprocating member of the toy being coupled to the second side component so that the second reciprocating member of the toy is movable relative to the main body of the toy while the toy remains coupled to the packaging assembly.

7. A reconfigurable toy and packaging assembly, comprising:

a toy having a main body and opposing first and second end members reciprocatingly coupled to the main body, the first and second end members being movable between a retracted position and an extended position relative to the main body; and a packaging assembly including a central component and opposing first and second side components movably coupled to the central component, the first side component being movable toward and away from the central component in a first direction and an opposite second direction, and the second side component being movable toward and away from the central component in a third direction and an opposite fourth direction, the first end member of the toy being coupled to the first side component and the second end member of the toy being coupled to the second side component so that the first and second end members are movable between the retracted and extended positions while the toy remains coupled to the packaging assembly.

8. The reconfigurable toy and packaging assembly of claim 7, wherein the first direction is opposite the third direction.

9. The reconfigurable toy and packaging assembly of claim 7, wherein the first direction is substantially perpendicular to the third direction.

10. The reconfigurable toy and packaging assembly of claim 7, wherein the central component includes a first pair of slots disposed in a first portion thereof and a second pair of slots disposed in a second portion thereof, the first side component has a first pair of clips slidably retained within the first pair of slots, and the second side component has a second pair of clips slidably retained within the second pair of slots.

11. The reconfigurable toy and packaging assembly of claim 10, wherein each of the clips includes a stem extending through a corresponding one of the slots, and a flange that is slidable against a surface of the central component.

12. The reconfigurable toy and packaging assembly of claim 7, wherein each of the first and second side components has a generally L-shaped configuration including a base and a backing extending upwardly therefrom, each base movably coupled to the central component.

13. The reconfigurable toy and packaging assembly of claim 7, wherein each of the first and second side components includes a base, and the base of the first side component is substantially coplanar with the base of the second side component.

14. A packaged toy, comprising:

a packaging assembly including a base portion, a first side portion, and a second side portion, the first side portion being movably coupled to the base portion, the second side portion being movably coupled to the base portion, the base portion including a first slot and a second slot formed therein, the first side portion including a coupler engaged with the first slot of the base portion to couple the first side portion to the base portion, and the second side portion including a coupler engaged with the second slot of the base portion to couple the second side portion to the base portion; and a toy including a first body portion and a second body portion, the second body portion being reciprocatingly coupled to the first body portion, the second body portion being coupled to and movable with the second side portion of the packaging assembly.

15. The packaged toy of claim 14, wherein each of the base portion, the first side portion, and the second side portion is generally L-shaped.

16. The packaged toy of claim 14, wherein the toy includes a third body portion that is reciprocatingly coupled to the first body portion, the third body portion being coupled to and movable with the first side portion of the packaging assembly.

17. The packaged toy of claim 16, wherein the first side portion and the second side portion are movable toward and away from each other in opposite directions.

18. The packaged toy of claim 16, wherein the first side portion is movable toward and away from the base portion in a first direction and an opposite second direction, and the second side portion is movable toward and away from the base portion in a third direction and an opposite fourth direction.

19. The packaged toy of claim 18, wherein the first direction is substantially perpendicular to the third direction.

20. The packaged toy of claim 14, wherein the first body portion is coupled to the base portion of the packaging assembly.

* * * * *